US006467947B1

(12) United States Patent
Welsh

(10) Patent No.: US 6,467,947 B1
(45) **Date of Patent: *Oct. 22, 2002**

(54) METHOD AND APPARATUS FOR MIXING

(75) Inventor: Martin Cyril Welsh, Endeavour Hills (AU)

(73) Assignee: Commonwealth Scientific and Industrial Research Organisation, Australian Capital Territory (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/485,911

(22) PCT Filed: Mar. 31, 1998

(86) PCT No.: PCT/AU98/00661

§ 371 (c)(1),
(2), (4) Date: Apr. 18, 2000

(87) PCT Pub. No.: WO99/08781

PCT Pub. Date: Feb. 25, 1999

(30) Foreign Application Priority Data

Aug. 19, 1997 (AU) ..... PO8656
Mar. 31, 1998 (AU) ..... PP2686

(51) Int. Cl.[7] ..... B01F 7/16
(52) U.S. Cl. ..... 366/279
(58) Field of Search ..... 366/262, 242, 366/244, 245, 247, 325.4, 325.92, 328.1, 265, 263, 270, 315, 279, 349

(56) References Cited

U.S. PATENT DOCUMENTS 1,008,010 A * 11/1911 Coe ..... 366/247
1,786,009 A * 12/1930 Duwe ..... 366/270
2,072,082 A * 3/1937 Butts ..... 366/247
2,269,736 A * 1/1942 Rogers ..... 366/247

(List continued on next page.)

FOREIGN PATENT DOCUMENTS

| | | | | |
|---|---|---|---|---|
| AU | 11523/61 | | 5/1963 | |
| AU | 32487/71 | | 2/1973 | |
| DE | 5751 | * | 9/1959 | ..... 366/262 |
| EP | 464654 | | 1/1992 | |
| GB | 1016129 | * | 1/1966 | ..... 366/265 |
| JP | 07-60093 A | | 3/1995 | |
| JP | 09276675 | | 10/1997 | |
| SU | 915923 | * | 8/1982 | ..... 366/262 |
| WO | WO 89/03722 | | 5/1989 | |

OTHER PUBLICATIONS

Selecting Turbine Agitators, by A.P. Weber, Chemical Engineering, Dec. 1964, pp 169–174.*

(List continued on next page.)

*Primary Examiner*—Tony G. Soohoo
(74) *Attorney, Agent, or Firm*—Sughrue Mion, PLLC

(57) ABSTRACT

A method and apparatus for mixing liquids or liquids (9) with particles (8) without the aeration of the liquid. The liquid and/or particles (8) opposed in a vessel (2) having an upper end (4) and a lower end (5) and a containing wall (3) extending between the upper and lower ends. A mechanical rotating means (6) disposed adjacent the upper end (4) and submerged in the liquid (9) is used to induce a rotational flow directed radially outward from a central region of the vessel towards the containing wall (3) to establish a swirling flow. The flow is characterised by an outer annular region (11) of moderate rotational flow adjacent the containing wall (3) moving from the upper end (4) toward the lower end (5), an inward flow adjacent the lower end of the vessel (2) and an inner core (12) of rotational flow about the central region of the vessel (2). The inner core flow (12) moves from the lower end (5) toward the upper end (4) and extends substantially from adjacent the lower end (5) of the vessel to the mechanical rotating means (6).

12 Claims, 3 Drawing Sheets

U.S. PATENT DOCUMENTS 2,530,814 A * 11/1950 De Becze et al. ..... 366/270
2,622,943 A * 12/1952 Wankat et al. ..... 366/247
2,875,897 A * 3/1959 Booth ..... 366/270
3,111,305 A * 11/1963 Bates et al.
3,182,970 A * 5/1965 Ivanoff
4,256,406 A * 3/1981 Somerville ..... 366/279
4,468,358 A * 8/1984 Haegeman ..... 366/279
4,499,063 A * 2/1985 Grosbois et al.
4,630,932 A * 12/1986 Revelli et al. ..... 366/315
4,984,899 A * 1/1991 Bollenrath et al.
5,261,745 A 11/1993 Watkins
5,314,506 A * 5/1994 Midler et al.
5,399,293 A * 3/1995 Nunez et al. ..... 366/279
5,533,803 A * 7/1996 Meier ..... 366/247
5,564,828 A * 10/1996 Haegeman ..... 366/270
5,800,797 A * 9/1998 Matsumoto et al.
5,921,679 A * 7/1999 Muzzio et al.

OTHER PUBLICATIONS

James Y. Oldshue, "Fluid Mixing Technology", (1983) McGraw–Hill Chemical Engineering Series, pp. 10, 18, 59–60.

Gary G. Tatterson, "Scaleup and Design of Industrial Mixing Processes", (1994), McGraw Hill Chemical Engineering Series, pp. 18–19.

Jaromir J Ulbrecht and Gary B. Tatterson (ed.), "Mixing Liquids of Mechanical Agitation", Gordon and Breach, Chemical Engineering: Concepts and Reviews (1985) at pp. 141–143, 149–150, 173–176, and 273–274.

* cited by examiner

METHOD AND APPARATUS FOR MIXING

FIELD OF THE INVENTION

This invention relates to apparatus for mixing liquids or liquid with particles to form slurries and the like. The apparatus of the present invention is suitable for mixing one liquid with another or mixing liquid with particles to form both homogeneous suspensions as well as mixtures in which not all of the particles are fully suspended. The invention is intended for applications where entrainment of gas from the liquid surface during mixing is undesirable and to be avoided.

BACKGROUND ART

Apparatus for mixing of this type has a number of applications in a wide variety of industrial processes. One such application is agitated precipitators used in the process of precipitating crystals from a supersaturated liquor. Precipitators of this type are used in a number of industrial processes. The invention will hereinafter be specifically described with reference to this application but it will be readily appreciated that the scope of the invention is not limited to this particular application.

One well known agitating precipitator is the Gibbsite precipitator used in the Bayer process to produce alumina hydrate from bauxite. Existing Gibbsite precipitators comprise a large vessel with a centrally disposed draft tube. An impeller is rotationally driven in the draft tube to provide a vertical circulation in the precipitator. In some cases baffles are provided around the sides of the vessel to prevent swirling or rotational flow in the slurry which otherwise impairs the desired vertical circulation. Existing Gibbsite precipitators use a large amount of input power to achieve the required circulation. Additionally, one of the objects of the precipitation process is to produce large crystal size in the precipitate. Because the existing Gibbsite precipitators involve a fairly energetic process as the slurry is drawn through the draft tube, there is a tendency to break crystal structures. This limits the size of the crystals that can be produced using these precipitators. Another difficulty with Gibbsite precipitators is the scaling that occurs on the precipitator walls due to the low flow velocities. In particular,a substantial deposition of material occurs in the bottom of the vessels and in the areas of stagnant flow. As a consequence, the vessels need to be periodically cleaned. Not only is cleaning an additional expense, but also provides a significant disruption to production and can reduce the life of the vessels.

Similar difficulties, in particular, the large power requirements exist in other apparatus for mixing liquids and liquids with particles in various industrial situations.

DISCLOSURE OF THE INVENTION

It is an object of this invention to provide a method and apparatus for mixing liquids and liquid with particles without entrainment of gas from the liquid surface which will overcome, or at least ameliorate, one or more of the forgoing disadvantages.

In one aspect this invention provides an apparatus for mixing liquids or liquid with particles without entrainment of gas from the liquid surface, said apparatus including a vessel to contain the liquid(s) having an upper end, a lower end and a containing wall extending between the upper and lower ends, a mechanical rotating device disposed adjacent said upper end and submerged in said liquid(s) to induce a rotational flow in the liquid directed radially outward from a central region of the vessel towards said containing wall to establish a swirling flow through the vessel characterised by an outer annular region of moderate rotational flow adjacent the containing wall moving from the upper end toward the lower end, an inward flow adjacent the lower end of the vessel, and an inner core region of rapid rotational flow about the central region of the vessel moving from the lower end toward the upper end and extending from substantially adjacent the lower end of the vessel to the mechanical rotating device.

In a further aspect this invention provides a method of mixing liquids or liquid with particles without entrainment of gas from the liquid surface, said method including the steps of placing the liquid(s) in a vessel having an upper end and a lower end and a containing wall extending between the upper and lower ends, inducing with a mechanical rotating device submerged in the liquid(s) in the part of the vessel adjacent the upper end a rotational flow in the liquid(s) directed radially outward from a central region of the vessel toward the containing wall to establish a swirling flow through the vessel characterised by an outer annular region of moderate rotational flow adjacent the containing wall moving from the upper end toward the lower end, an inward flow adjacent the lower end of the vessel, and an inner core region of rapid rotational flow about the central region of the vessel moving from the lower end toward the upper end and extending substantially from adjacent the lower end of the vessel to the mechanical rotating device.

In the swirling flow induced by the mechanical rotating device according to this invention the rotational flow is preferably about zero at the centre of the inner annular region and greatest toward the outer edge of that region.

Preferably, the mechanical rotating device inducing the rotational flow includes a paddle or impeller. The paddle or impeller preferably rotates about a central axis. The paddle or impeller preferably only operates in the central region of the vessel. Preferably the blades of the paddle or impeller extend from a central hub or are otherwise outwardly offset from the axis of rotation.

The vessel preferably has a circular cross-section. In one form of the invention a conical base section joins the containing wall toward the lower end of the vessel. In another form the base is flat. Preferably, the rotational speed of the paddle or impeller used to induce the flow is selected to achieve the desired flow velocities. Preferably, the liquid velocity adjacent the containing wall (outside the boundary layer) is between about 0.3 m/s and 1 m/s. Most preferably this velocity is greater than 0.5 m/s. In aluminia precipitators this has been found to ensure there is no scale build up on the precipitator walls. Maximum liquid tangential velocity in this inner core is preferably about 3 times the velocity adjacent the containing wall.

The present invention has particular application to vessels that have a height equal to or greater than the diameter of the vessel. The present invention has been found to provide satisfactory mixing in vessels having heights equal to and up to four times the diameter. Many prior art mixing devices are unable to provide satisfactory mixing in these configurations.

Preferably, the apparatus includes a device to provide a through flow of liquid through the vessel. Preferably, the device enhances the rotation of the liquid in the vessel.

In one specific application the invention provides a precipitator including a vessel having a smoothly continuous vertical wall at least in a horizontal direction to contain a slurry, a mechanical rotating device disposed in the upper part of said vessel and submerged in the slurry to induce a rotational flow in the slurry directed radially outward from the centre of the vessel to establish a swirling flow of the slurry through the vessel characterised by an outer annular region of downwardly moving moderate rotational flow adjacent the vertical wall, an inward flow across the bottom of the vessel, and an inner core region of upwardly moving rapid rotational flow about the centre of the vessel extending substantially from the bottom of the vessel to the mechanical rotating device.

Also in a specific application the invention provides a method of precipitating from a slurry including the steps of placing the slurry in a vessel having a smoothly continuous vertical wall at least in a horizontal direction, inducing in the upper part of the vessel with a mechanical rotating device submerged in the slurry a rotational flow in the slurry directed radially outwardly from the centre of the vessel to establish a swirling flow through the vessel characterised by an outer annular region of downwardly moving moderate rotational flow adjacent the vertical wall, an inward flow across the bottom of the vessel, and an inner core region of upwardly moving rapid rotational flow about the centre of the vessel extending substantially from the bottom of the vessel to the mechanical rotating device.

According to another improvement possible with this invention it is possible to operate the mixing apparatus on a non-continuous basis. This can be achieved by operating the mechanical rotating device used to induce the flow for example until an equilibrium is reached. and then allowing the momentum of the liquid to continue mixing until rotation decays to a predetermined level or for a set period at which time the paddle or a propeller is again operated. This process can allow a considerable reduction in power requirements particularly if it is possible to minimise the amount of time that power is required to be delivered during periods of peak cost of electrical power.

Preferably, the input power to the precipitator is less than 20 Watts/cubic meter. Power inputs as low as 7 or 8 Watts/cubic meter can maintain the suspension and mixing performance.

A further advantage of the invention is that solid material which would settle at the bottom of the vessel following a shutdown is more easily resuspended.

It has also been found that when the apparatus of the present invention is used as a precipitator an advantage can be obtained in terms of yield by the increased natural cooling due to absence of scale and increased fluid velocity over the walls and floor. In addition, cooling the walls of the vessel with water during operation can further enhance this effect.

A significant difference between the method and apparatus of this invention and prior art mixers resides in the intentional creation of the swirling or rotational flow. In prior art devices such flow is considered undesirable and baffles have been used to prevent it being established. Additionally, in accordance with the present invention the mechanical rotating means is submerged in the liquid. This prevents unwanted entrainment of gas from the liquid surface. The submerged mechanical rotating means also prevents waves or "sloshing" on the surface of the liquid.

The invention will now be described, by way of example only, with reference to the accompanying drawings.

BEST MODES FOR CARRYING OUT THE INVENTION

The method and apparatus of this invention will be described in relation to a laboratory scale version of a precipitator. This description is for the purposes of illustration only and is not intended to limit the scope of the invention. Additionally, a commercial precipitator for use in the Bayer process has also been built. The commercial version of the apparatus is approximately 11 meters in diameter and has a height of around 28 meters. This corresponds to a volume of about2.7 megaliters. This description is also by way of example only and not intended to be limiting on the interpretation of the scope of the invention.

Figure 1:
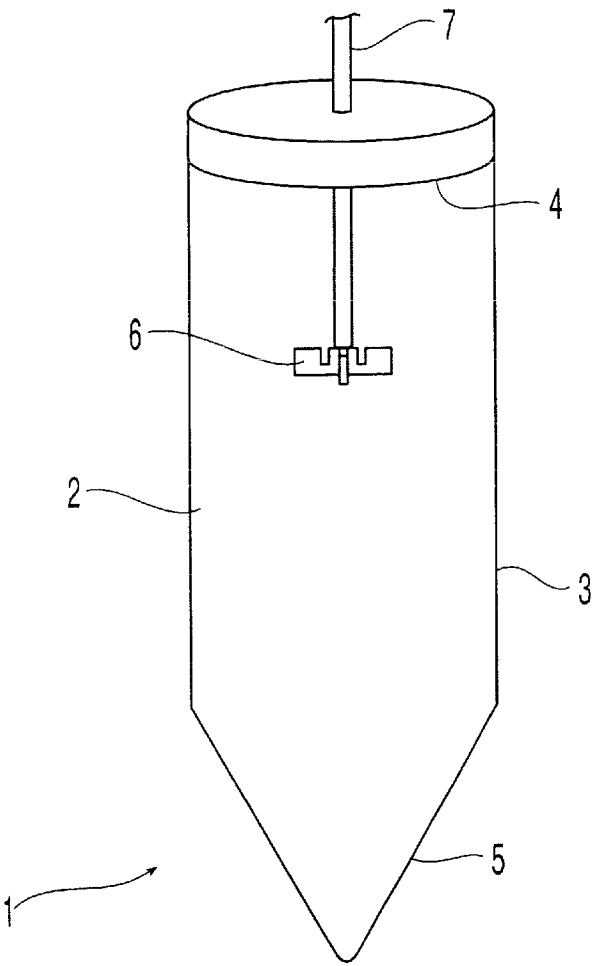
FIG. 1 is a schematic sectional view of a precipitator according to this invention.
Figure 2B:
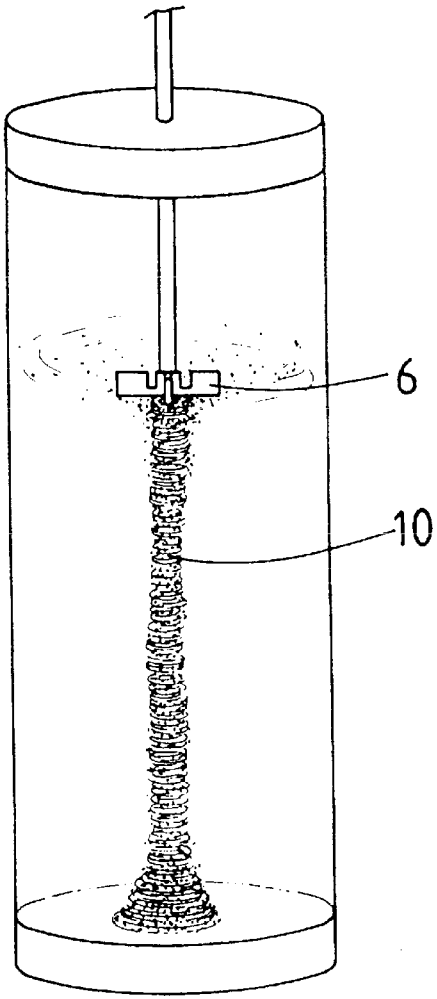
FIGS. 2*a* to 2*d* show dispersion patterns of spherical polystyrene beads in a hydrodynamic test rig (a) with the agitator stationary, (b) 27 seconds after switching on the agitator, (c) 36 seconds after switching on the agitator, (d) in a final steady state.
Figure 2A:
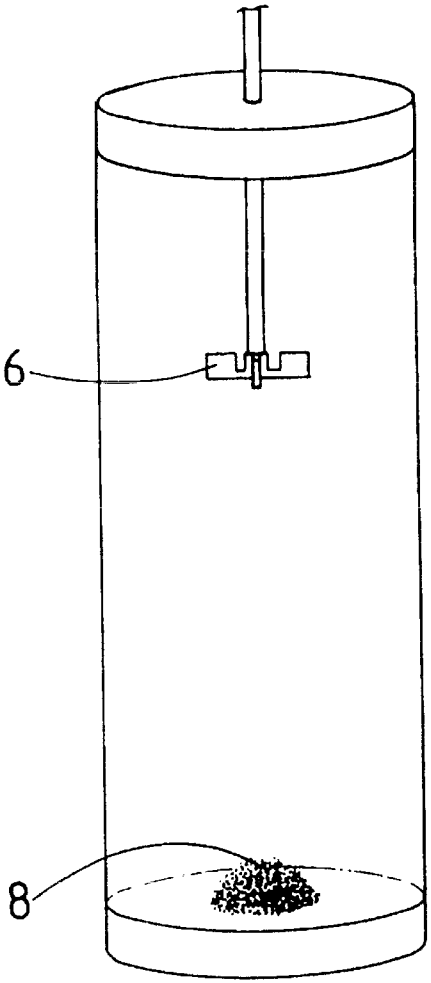
Figure 2D:
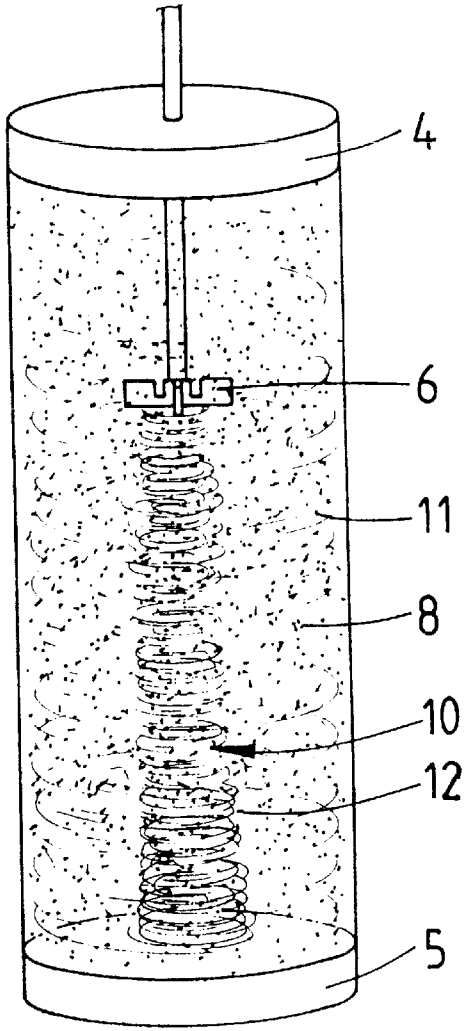
Figure 2C:
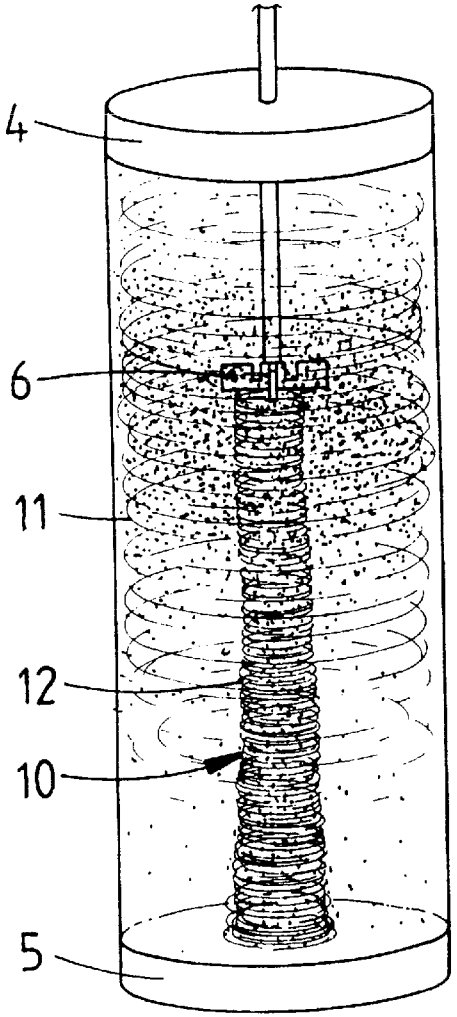

As shown in FIG. 1, the precipitator 1 of this invention comprises a vessel 2 formed by a smooth walled vertical cylinder 3 having an upper end 4 and a conical bottom 5. A Rushton turbine 6 is mounted on a shaft 7 for rotation by a drive motor (not shown). A laboratory scale version of the precipitator has been built utilising the configuration shown in FIG. 1. The laboratory version also includes means to introduce a through flow of slurry in the vessel such as would be required in an industrial precipitator. The through flow is pumped from underneath the turbine 6 and returned to the vessel so that it enhances the swirling flow in the tank. This is achieved by directing the inflow and outflow channels tangentially or near tangentially so that the inflow and outflow are substantially in the direction of rotation.

FIGS. 2*a* to 2*d* show dispersion patterns of spherical polystyrene beads 8 in a liquid 9 in a hydrodynamic test rig. The test rig is generally similar to the arrangement described in relation to FIG. 1 without the conical base 5. The patterns shown in FIG. 2 are without any through flow of liquid. The steady rotational speed of the turbine 6 used in the test rig shown in FIG. 2 is 200 rpm.

The test rig clearly shows the beads 8 being suspended from the bottom 5 of the vessel 2 in a column or core 10 stretching all the way up to the turbine 6. On reaching the turbine 6 the beads 8 are deflected towards the outer wall 3 of the vessel 2 and returned to the bottom in an outer annulus 11 adjacent wall 3 along a spiral path and with a moderate rotational flow. In the column 10 of particles 8 stretching from the bottom 5 of the vessel 2 up to the turbine 6, the particles 8 are found to predominate in a thin annulus 12 at the outer edge of the core 10 with little or no particles located near the axis of symmetry of the test rig. The vertical motion and the rotational flow of particles 8 located in the outer annular region 12 of the core 10 is very high while the motion of liquid near the axis of symmetry is relatively low.

Figure 3:
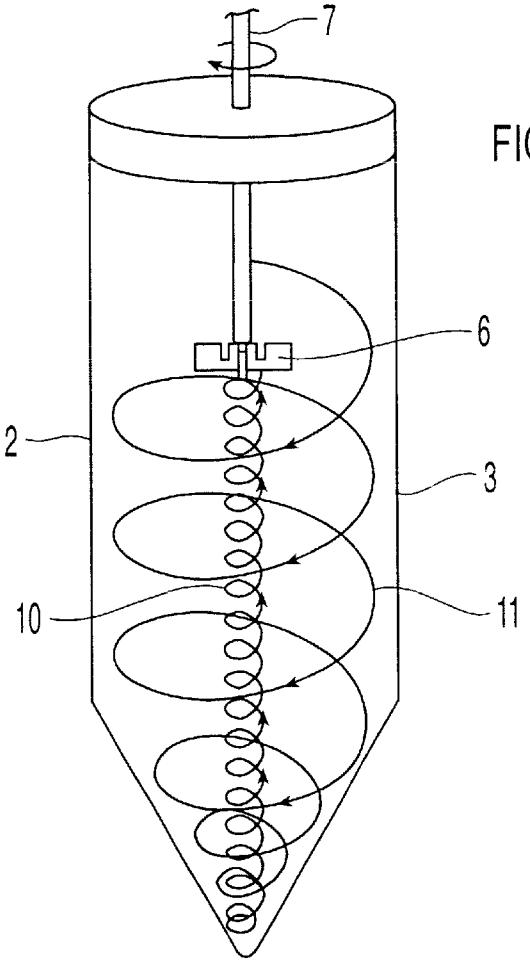
FIG. 3 is a schematic diagram of the flows induced in the precipitator of FIG. 1.

FIG. 3 shows a schematic depiction of the flows induced in the precipitator configuration of FIG. 1.

Studies of the laboratory scale version of the precipitator according to this invention have shown that:

1. The swirling flow is stable and robust and confirms that it is possible to generate high flow velocities at the wall of the vessel and thus minimise scale growth.

2. Large power savings should be available in a full size precipitator based on the precipitator of this invention. It is estimated that at least a 63% saving in power over the currently employed draft tube precipitators can be achieved.

3. The draft tube can be eliminated from the precipitator.

4. A clarified zone in the form of a vertical column of liquid rotating around the centre line of the vessel can be formed.

5. The flows generated in the vessel are insensitive to introducing a through flow provided the slurry enters the precipitator near the wall in a tangential direction so as to enhance the induced swirl.

6. Considerably less scale can be expected in the precipitator compared to precipitators of other types.

7. The precipitator of this invention offers increased cooling due to higher flow velocities near the walls of the vessel and the absence of scale 8. Improved precipitate recovery is expected because the precipitate deposited as scale in prior art precipitators will form product in the precipitator of this invention.

9. The swirling flow has a beneficial effect on the extent of agglomeration, the rate of agglomeration and the resultant size enlargement of product crystals.

10. The strength of the product crystals from the precipitator of this invention measured as an attrition index after 300 minutes of precipitation is higher than product from a comparable draft tube fitted precipitator.

11. Solids in the precipitator of this invention are segregated with a high concentration of solids in the lower half of the tank.

In the commercial scale precipitator described above when used as a Gibbsite precipitator it has been possible to achieve an input power reduction to approximately 37% of the previous level whilst maintaining comparable performance. In typical operation an agitation rotational speed of 17 rpm has been found to produce a slurry velocity of about 0.6 m/s adjacent the precipitator wall (outside the boundary layer) and a maximum velocity in the centre core of about 2 m/s at an input power of about 24 kilowatts. Additionally, an 85% reduction in scale growth on the precipitator has been observed over a period of about 6 months production operation. These improvements in performance have been achieved whilst maintaining the same or a slightly increased yield. Additional benefits are related to the ability of the precipitator of the present invention to re-suspend solids after shutdown and to continue operations in a turndown mode without serious re-start problems.

The foregoing describes only one embodiment of this invention and modifications can be made without departing from the scope of this invention.

What is claimed is:

1. An apparatus for mixing liquids or liquid with particles without entrainment of gas from the liquid surface, said apparatus including a vessel to contain the liquid(s) having an upper end, a lower end and a generally cylindrical containing wall extending between the upper and lower ends, a mechanical turbine for rotation about a generally vertical axis disposed adjacent said upper end and submerged in said liquid adjacent the liquid surface to induce a rotational flow in the liquid(s) that moves radially outward in a generally horizontal plane from the mechanical rotating turbine in a central region of the vessel towards said containing wall to establish a stable swirling flow through the vessel characterised by (i) an outer annular region of moderate rotational flow around said vertical axis adjacent the containing wall moving from the upper end toward the lower end so as to maintain a continuous flow of liquid over the containing wall, (ii) an inward flow adjacent the lower end of the vessel, and (iii) an inner core region of rapid rotational flow around said axis about the central region of the vessel moving from the lower end toward the upper end and extending from substantially adjacent the lower end of the vessel to the mechanical turbine.

2. An apparatus as claimed in claim 1 wherein the mechanical turbine causes the rotational flow to be about zero at the centre of said inner annular region and causes a maximum rotational flow toward the outer edge of that region.

3. An apparatus as claimed in claim 2 wherein the mechanical turbine causes the rotational flow to be such that the maximum liquid flow tangential velocity in the inner angular region is about 3 times the liquid flow velocity adjacent the containing wall.

4. An apparatus as claimed in claim 3 wherein the mechanical turbine causes the rotational flow to be such that the liquid velocity adjacent the containing wall is between 0.3 m/s and 1 m/s.

5. An apparatus as claimed in claim 4 wherein the mechanical turbine causes the rotational flow to be such that the liquid velocity adjacent the containing wall is greater than about 0.5 m/s.

6. An apparatus as claimed in claim 1 wherein said mechanical turbine is a paddle or impeller.

7. An apparatus as claimed in claim 1 wherein the vessel includes a generally conical base.

8. An apparatus as claimed in claim 1 wherein the vessel includes a generally flat base.

9. An apparatus as claimed in claim 1 further including a device to provide a flow of liquid through the vessel.

10. An apparatus as claimed in claim 9 wherein said device enhances the rotational flow of liquid in the vessel.

11. An apparatus as claimed in claim 1 herein the input power to the mechanical turbine is less that about 20 Watts/cubic meter of liquid in the vessel.

12. A method of mixing liquids or liquid with particles without entrainment of gas from the liquid surface, said method including the steps of placing the liquid(s) in a vessel having an upper end and a lower end and a generally cylindrical containing wall extending between the upper and lower ends, inducing a flow in the liquid with a mechanical turbine rotating about a generally vertical axis submerged in the liquid(s) adjacent the liquid surface in the part of the vessel adjacent the upper end, said flow being rotational and moving radially outward from the mechanical turbine in a central region of the vessel toward the containing wall to establish a stable swirling flow through the vessel characterised by (i) an outer annular region of moderate rotational flow around said vertical axis adjacent the containing wall moving from the upper end toward the lower end so as to maintain a continuous flow of liquid over the containing wall, (ii) an inward flow adjacent the lower end of the vessel, and (iii) an inner core region of rapid rotational flow around said axis about the central region of the vessel moving from the lower end toward the upper end and extending substantially from adjacent the lower end of the vessel to the mechanical turbine.

* * * * *

UNITED STATES PATENT AND TRADEMARK OFFICE

CERTIFICATE OF CORRECTION

PATENT NO. : 6,467,947 B1
DATED : October 22, 2002
INVENTOR(S) : Martin Cyril Welsh It is certified that error appears in the above-identified patent and that said Letters Patent is hereby corrected as shown below:

Title page,
Item [73], should read as follows:
-- [73] Assignees: Commonwealth Scientific and Industrial Research Organisation, Australian Capital Territory (AU); and Queensland Alumina Ltd. Queensland (AU)
[22] PCT Filed: Aug. 19, 1998

Signed and Sealed this

First Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,467,947 B1
DATED : October 22, 2002
INVENTOR(S) : Martin Cyril Welsh It is certified that error appears in the above-identified patent and that said Letters Patent is hereby corrected as shown below:

Column 6,
Line 64, after claim 12, insert the following claims:

13. A method as claimed in claim 12 wherein the rotational flow is about zero at the centre of said annular region and greatest toward the outer edge of that region.

14. A method as claimed in claim 13 wherein the maximum tangential liquid flow velocity in the inner annular region is about 3 times the liquid flow adjacent the containing wall.

15. A method as claimed in claim 14 wherein the liquid velocity adjacent the containing wall is between 0.3 m/s and 1 m/s.

16. A method as claimed in claim 15 wherein the liquid velocity adjacent the containing wall is greater than about 0.5 m/s.

17. A method as claimed in claim 12 wherein said mechanical turbine is a paddle.

18. A method as claimed in claim 12 wherein the vessel includes a generally conical base.

19. A method as claimed in claim 12 wherein the vessel includes a generally flat base.

20. A method as claimed in claim 12 further including the step of establishing a flow of liquid through the vessel.

21. A method as claimed in claim 12 wherein the flow of liquid through the vessel enhances the rotational flow of liquid in the vessel.

22. A method as claimed in claim 12 further including the steps of operating the mechanical turbine until an equilibrium is substantially reached and discontinuing the operation of the mechanical rotating device and allowing the momentum of the liquid to continue mixing.

23. A method of precipitating from a slurry including the method as claimed in claim 12.

Signed and Sealed this

Eighth Day of June, 2004

JON W. DUDAS
*Acting Director of the United States Patent and Trademark Office*